United States Patent [19]

Wolfsgruber et al.

[11] 4,292,075

[45] Sep. 29, 1981

[54] SLOW FADE INOCCULANT AND A PROCESS FOR THE INOCCULATION OF MELTED CAST IRON

[75] Inventors: Friedrich Wolfsgruber, Tacherting; Hans W. Kasel, Saarbrücken-Bischmisheim; Manfred H. A. Odendahl, Saarbrücken-Brebach; Wolfram W. Mörsdorf, Saarbrücken-Bischmisheim, all of Fed. Rep. of Germany

[73] Assignees: SKW Trostberg Aktiengesellschaft, Trostberg; Halbergerhutte GmbH, Saarbrucken, both of Fed. Rep. of Germany

[21] Appl. No.: 90,719

[22] Filed: Nov. 2, 1979

[30] Foreign Application Priority Data

Nov. 3, 1978 [DE] Fed. Rep. of Germany ..... 2847787
Oct. 9, 1979 [DE] Fed. Rep. of Germany ..... 2940946

[51] Int. Cl.[3] ..... C22C 33/08
[52] U.S. Cl. ..... 75/130 R; 75/53; 75/257
[58] Field of Search ..... 75/53, 130 R, 257

[56] References Cited

U.S. PATENT DOCUMENTS

| | | | |
|---|---|---|---|
| 3,318,687 | 5/1967 | Bowden | 75/53 |
| 3,649,248 | 3/1972 | Ishimitsu | 75/257 |
| 3,669,618 | 6/1972 | Cappel | 75/257 |
| 3,726,665 | 4/1973 | Minnick | 75/257 |
| 3,771,999 | 11/1973 | Fedock | 75/257 |
| 3,793,006 | 2/1974 | Kawawa | 75/257 |
| 3,802,865 | 4/1974 | Ohkubo | 75/53 |

*Primary Examiner*—P. D. Rosenberg
*Attorney, Agent, or Firm*—Sughrue, Rothwell, Mion, Zinn and Macpeak

[57] ABSTRACT

A slow fade cast iron inocculant is made up of (a) a silicon-containing matrix of iron silicon alloys and having a crystal structure, (b) compounds, present in the matrix crystal structure, of high-melting point calcium aluminum silicates, generally in the form $CaO.Al_2O_3.2SiO_2 + Al_2O_3.2SiO_2$, and (c) a dicalcium aluminum silicate material with up to 20% by weight of silicon carbide and 10% by weight of calcium carbide.

The relation between the matrix and the high-melting point calcium aluminum silicates to the dicalcium silicate material is about 1 to 0.05–0.2. The amount of high-melting point calcium aluminum silicates in the matrix is 5 to 30% by weight and, more specially 8 to 15% by weight.

14 Claims, 12 Drawing Figures

White-solidifying tendency in an induction furnace against time in the case of the use of a normally used inoculant Fig. 2 White-solidifying tendency in an induction furnace against time with and without addition of inoculant Supercooling
(1150°C - T sol min) °C
30
20
10
scatter of figures for supercooling
casting ladle
teeming
Induction furnace iron before processing with Mg
120 MIN.
after processing with Mg
2MIN.
after inoculation with 0.8% FeSi-75
2MIN.
ladle to start of teeming first mask after 0.1% teeming inoculation
20 MIN.
ladle to end of teeming last mask after 0.1% teeming inoculation

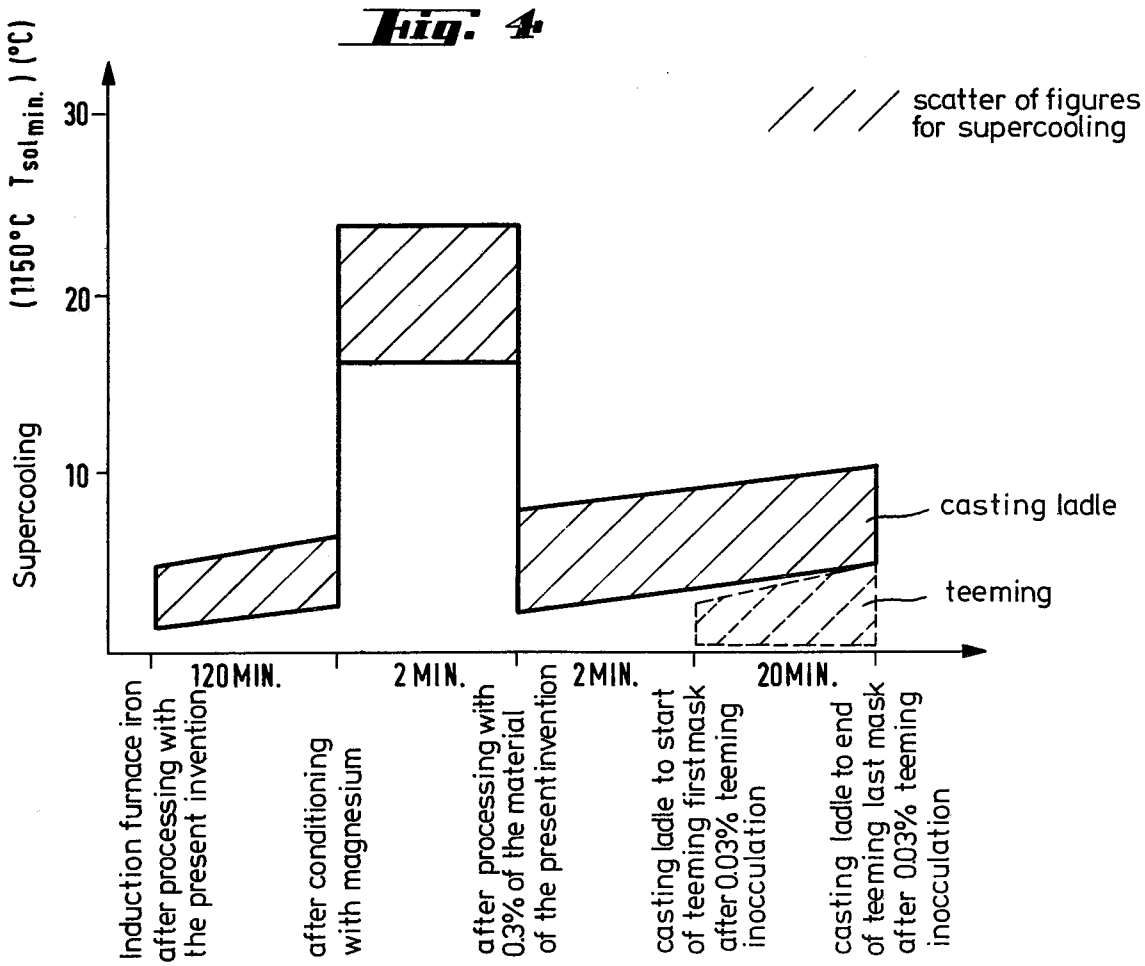
Fig. 4
scatter of figures for supercooling
casting ladle
teeming
Supercooling
(1150°C $T_{sol_{min.}}$) (°C)
30
20
10
induction furnace iron after processing with the present invention
120MIN.
after conditioning with magnesium
2MIN.
after processing with 0.3% of the material of the present invention
2MIN.
casting ladle to start of teeming first mask after 0.03% teeming inocculation
20MIN.
casting ladle to end of teeming last mask after 0.03% teeming inocculation heat of crystallization Q after inocculation with 0.8% FeSi-75

- ladle - heat of crystallization Q after inocculation with 0.8% FeSi-75 and 0.1% inocculation on teeming

- teeming - heat of crystallization Q in the case of processing the melt according to the present invention

- casting ladle - heat of crystallization Q after processing the melt in the present invention

- teeming - maximum of 2nd differential coefficient $(\frac{dT}{dt})'$ (°C/sec²)

maximum of 2nd differential coefficient $\frac{d^2T}{dt^2}$ after inocculation with 0.8% FeSi-75

- ladle - maximum of 2nd differential coefficient $(\frac{dT}{dt})'$ (°C/sec²)

maximum of 2nd differential coefficient $\frac{d^2T}{dt^2}$ after inocculation with 0.8% FeSi-75 and 0.1% teeming inocculation

- teeming-maximum of 2nd differential coefficient $\frac{d^2T}{dt^2}$ after processing the melt according to the present invention

- casting ladle - maximum of 2nd differential coefficient $(\frac{dT}{dt})'$ (°C/sec$^2$)

maximum of 2nd differential coefficient $\frac{d^2T}{dt^2}$ after processing of melt in the present invention

- teeming -

SLOW FADE INOCCULANT AND A PROCESS FOR THE INOCCULATION OF MELTED CAST IRON

BACKGROUND OF THE INVENTION

The present invention is with respect to an inocculant for processing cast iron and a process for use of the inocculant.

By definition the amount of carbon in cast iron is greater than 1.7%, small amounts of manganese, phosphorus, sulfur and silicon being present as well. When melted cast iron becomes solid, a part of the carbon is segregated out as graphite (in the cast of gray cast iron) or as $Fe_3C$ (cementite, in the case of white cast iron). The sort and amount of the impurities and other substances in the iron together with the selection of the rate of cooling, as dependent on the thickness of the casting on hand, have different effects on the solidification of the casting. Because white-solidified cast iron may not be readily machined because of its hardness and brittleness, white solidification is undesired for most uses and is stopped or limited by inocculation of the melted iron.

The inocculant which has been most widely and longest used is ferrosilicon with about 75% of silicon. Its effect is produced not only by the graphitizing caused by its silicon, but, to a great degree, certain controlled amounts of aluminum and calcium. The effect may be further increased by other materials such as barium, zirconium and strontium.

Other normally used inocculants are 30/60 calcium-silicon, mixed ferrosilicon and calciumsilicon and, furthermore, graphite.

It may be generally said that the inocculation of liquid metals is the placing of impurity nuclei in the melted material, which take the form of crystallization centers for the forming of graphite. In this respect, the inocculation effect is said to be caused only by solid crystalization nuclei. For this purpose substances with metallic, and furthermore substances with non-metallic properties, as for example oxides, sulfides, nitrides, borides and carbides may be used, while compounds which are broken down under the effect of heat, go into solution in the melted material or undergo reduction or decomposition may not be used as inocculants.

Generally speaking, there are two forms of inocculation: first-stage inocculation in the ladle as a single-stage process and first-stage inocculation in the ladle together with later, second-stage inocculation right before teeming or solidfying of the melt in the mold.

The overall amount of inocculant used is between about 0.1 and 0.8% by weight. With such amounts white-solidification of the cast iron may be stopped or limited to the desired degree, nucleation of the melt may be made better and graphite crystallization helped. However, such conditions are not without a parallel effect on the properties of the completed casting: With an increase in the amount of inocculant, undesired properties are produced, such as a decrease in hardness, an increase in blowholes, porosity, greater cracking, thicker flaking of graphite, amongst others.

SHORT OVERVIEW OF THE PRESENT INVENTION

For this reason, attempts have been made at the development of nucleating melt inocculants keeping their effect for a longer time, that is to say low fade inocculants. For example the German Auslegeschrift specification No. 1,758,004 has a suggestion for a fine-grain, synthetic silicon dioxide as such a melt inocculant or addition. However, judging from attempts at making use of this invention for normal works use, it does not seem that this inocculant has any low fade properties.

One purpose of the present invention is the development of a low fade inocculant, that is to say one which keeps its properties for a long time, for cast iron in a melting furnace or in an apparatus for keeping it hot. A further purpose of the present invention is that of decreasing greatly the amount of inocculant needed for the later inocculant addition itself.

The present invention is based on an inocculant for melted cast iron and, in the invention, this inocculant is characterised in that it is made up of (a) a silicon-containing matrix of iron silicon alloys and having a crystal structure, (b) compounds, present in the matrix crystal structure, of high-melting point calcium aluminum silicates generally of the form $CaO.Al_2O_3.2SiO_2+3Al_2O_3.2SiO_2$, (c) a dicalcium aluminum silicate material with up to 20% by weight of silicon carbide and 10% by weight of calcium carbide.

in which respect the relation of the calcium-containing matrix with the high-melting point calcium aluminum silicates to the dicalcium silicate material is about 1 to 0.05–0.2 and the amount of high-melting point calcium aluminum silicates in the silicon-containing matrix is 5 to 30% by weight and more specially 8 to 15% by weight.

The amount of inocculant to melted cast iron may be 0.05 to 1% by weight or, more specially, 0.1 to 0.5% by weight.

The addition of the inocculant to the cast iron may take place in the melting apparatus, in and before the apparatus for keeping the cast iron hot or in the forehearth.

Furthermore the inocculant addition may be made to the burden or part of the burden before melting in an amount of 0.05 to 4% by weight.

In the case of producing cast iron with nodular or vermicular graphite by conditioning the melted iron with magnesium and/or rare earth metals, an addition is made, right before this conditioning, of a further amount of inocculant in an amount of 0.1 to 0.7% by weight and, more specially 0.2 to 0.4% by weight.

Surprisingly, the purpose of the invention is effected with an inocculant as noted or a process for inocculation as given.

It has been seen from tests that the inocculants of the present invention put an end to the shortcomings as noted of past inocculants and keep up the nucleating property of cast iron melt even at high temperatures (1150° C.), even if such temperatures are kept to for over 3 hours. For this reason, the different tendency of the melt to undergo white-solidification (on casting) in the furnace is decreased to a lower limiting value, at which it is kept unchangingly for more than 3 hours. Generally, normal inocculation before teeming or on teeming may be limited to very small amounts of inocculant, which are at the same level for each tapping operation. The small amounts of inocculants of, for example 0.05 to 0.1% by weight, make it possible to get an unchanging end level of silicon in the melt, so that it is possible to keep to tighter tolerances in the different properties of the cast iron, which is then of an unchanging quality.

In a cast iron melting works using line frequency crucible furnaces, the tendency to white-solidification is measured on a sample and to get the best graphitizing effect, adjustment takes place by additions of inocculant. In the case of furnaces for some tonnes of metal, from which, on each tapping operation, only a little melt is run off, so that some hours may go by before all metal has been cleared from the furnace, there is, however, a smoothly increasing tendency to white-solidification. This may be overcome by increasing amounts of inocculant on tapping. The castings will then have different silicon levels, this having an effect on the behavior on teeming and furthermore the material properties of the castings will become less good for every increase in the amount of inocculant.

On the other hand, the low fade inocculant of the present invention makes it possible for the white-solidification tendency of the melt to be kept unchanging at a low level so that, on teeming, only further conditioning with small, unchanging amounts of inocculant are necessary. For this reason there are less changes in the solidification behavior of the cast iron and its quality from one tapping operation to the next one.

The inocculant of the present invention is made up of two substances with different effects. One of these substances is the iron silicon alloy, which, as is part of knowledge in the art, has the effect of producing the inocculated condition of the cast iron melt at once, and lastly, the low-fade inocculant itself, made up of high-melting point calcium aluminum silicates ($CaO.Al_2O_3.2SiO_2+Al_2O_3.2SiO_2$), the dicalcium silicate material, silicon carbide and calcium carbide. These substances make it possible for the nucleation condition of the inocculated melt to be kept up for a long time. It has turned out to be useful if the dicalcium silicate material make up about 5 to 20% by weight of the iron silicate material and calcium aluminum silicate together. The level of the calcium aluminum silicate together. The level of the calcium aluminum silicate is to be between about 5 and 30% by weight of the iron silicon alloy. A specially good effect is produced if the percentage by weight is roughly 8 to 15.

For producing cast iron with nodular or vermicular graphite, nodulating materials such as magnesium and/or rare earth metals are used. The process of the present invention has turned out to be useful for producing such cast iron, in which respect, while it is true that the addition of magnesium or the like has the effect of increasing the tendency to white-solidification, the tendency is not as marked as is the case with melts not conditioned by using the present invention. It is only in this case, as part of a further development of the invention, that a further conditioning of the melt after being processed with magnesium or the like, has to take place using the inocculant of the present invention in amounts equal to 0.1 to 0.7% by weight and, more specially 0.2 to 0.4% by weight.

In this respect small amounts of inocculant of the present invention are enough. Further inocculation, after processing with magnesium or the like, with the inocculant of the present invention is, for this reason, a step usefully rounding off and completing the inocculation of the melt undertaken in the present invention in the first place.

It is not possible to say that this further inocculation is, in any way, like the addition of purely deoxidizing material (such as ferrosilicon), because the addition of the inocculant of the present invention is not only responsible for deoxidation, but furthermore is responsible for producing thermally stable nuclei in the melt, this making certain of a low fade rate after inocculation, that is to say the inocculation effect is kept up for a long time.

This further development of the process of the invention makes possible casting times of 20 minutes and longer, nodular graphite or vermicular graphite structure castings of an even, high quality being produced.

Inocculation into the mold or on teeming, only makes necessary very small amounts, the same in all cases, of inocculant which make certain of, generally speaking, unchanging physical properties of the castings because the behavior on solidification is the same in all cases.

With this further development of the process of the invention making use of smaller amounts of inocculant the number of solidification blowholes is decreased to the lowest possible level, that is to say the level possible in nodular graphite cast iron.

It is furthermore possible to see from the solidification behavior of such melts using the first and second differential coefficients of the cooling curve $dT/dt$ and $d^2T/dt^2$, the relation between time and the heat of crystallization with respect to the nucleated condition, the supercooling temperature, the forming of graphite and blowholing, that such melts are markedly different to melts processed, for example, with 0.8% FeSi.

In the case of an unchanged chemical makeup, the higher the latent heat of formation L or the heat of crystallization Q, measured in J/g, the greater the amount of graphite which is segregated out between the solidus and liquidus temperature and has the effect of decreasing blowholes. The melts conditioned with this form of the process of the invention furthermore have the best possible feeding properties, a low tendency with respect to forming blowholes and the condition that the maximum of the second differential coefficient of the cooling curve against time is generally in line with the limiting value for vermicular graphite-forming.

Furthermore, with such conditioned melts, the curve of the relation between time and heat of crystallization is marked by a wide primary austenite range with the forming of a fine primary dendrite network with small graphite nodules and a generally flat curve path in the range of the eutectic heat of crystallization, so that the rest of the melt is kept in a liquid condition for a long time, teeming and feeding properties into the molds are made better and there is a high feeding efficiency.

LIST OF FIGURES

Some examples will now be given of the invention, which, however, are not to have the effect of limiting the invention in any way.

FIG. 4 is a graph with respect to case iron processed using the present invention.

EXAMPLES OF THE INVENTION

EXAMPLE 1 (comparison example, cast iron with flake graphite)

The reference makeup or analysis and temperature of melted cast iron underwent adjustment in a line frequency induction crucible furnace or apparatus for keeping the material hot, the apparatus having a buffer function. Even although there were no changes in the analysis and the temperature, the white-solidification tendency of the melt (measured in the form of white-solidification in a cast wedge) underwent changes.

Without being dependent on the tendency to white-solidification of the cast iron in the furnace at the start, this tendency became higher the longer the cast iron was kept in the apparatus for keeping it hot, this making necessary adjustment with ever increasing amounts of inocculant on teeming (for example up to 0.5%). The castings had:

a great number of eutectic cells,
coarse A-graphite,
high tensile strength,
many blowholes,
a tendency to porosity,
a low hardness,
a high percentage of reaction products (slag).

The material properties of these castings are presented in table 1.

On keeping the metal in a melted condition for a longer time, making necessary greater additions of inocculant, these properties became worse.

EXAMPLE 2 (comparison example—cast iron with flake graphite)

Using normally marketed inocculants, an attempt was made at decreasing the tendency of cast iron to white-solidification, while the iron was still in an induction crucible furnace or apparatus for keeping it melted, to a lower limiting value and, in so doing, decreasing the amount of inocculant on teeming to 0.1% at the most, so that it would be possible to have a generally unchanging end-level of silicon and an unchanging quality of the cast iron.

Figure 1:
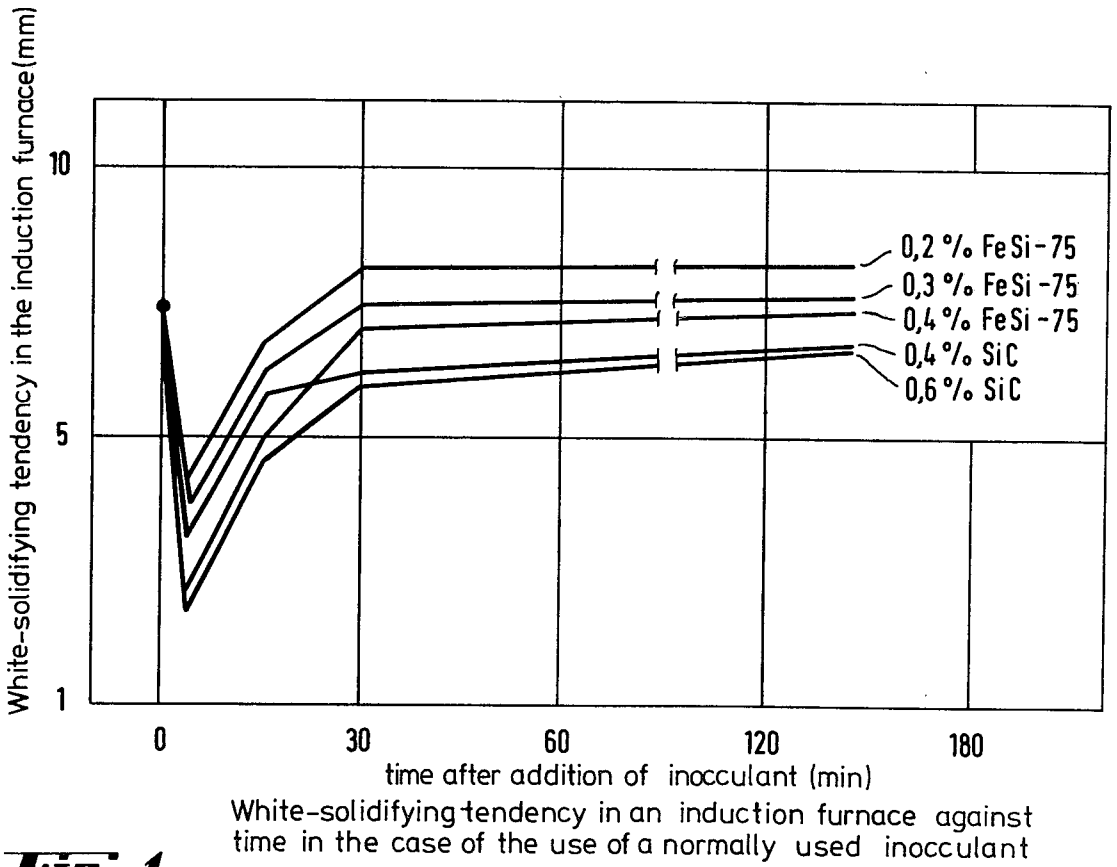
FIG. 1 is a graph of the white-solidifying tendency in an induction furnace against time in the case of the use of a normally used inocculant.

As will be seen from FIG. 1, it was not possible for the inocculation effect to be stretched out to a time greater than 3 hours (as had been desired), and in fact the effect had faded away after 30 minutes at the most. The white-solidification tendency of the melt had to undergo adjustment by amounts of inocculant the same as in normal processing (table 2).

EXAMPLE 3 (flake graphite cast iron)

Figure 2:
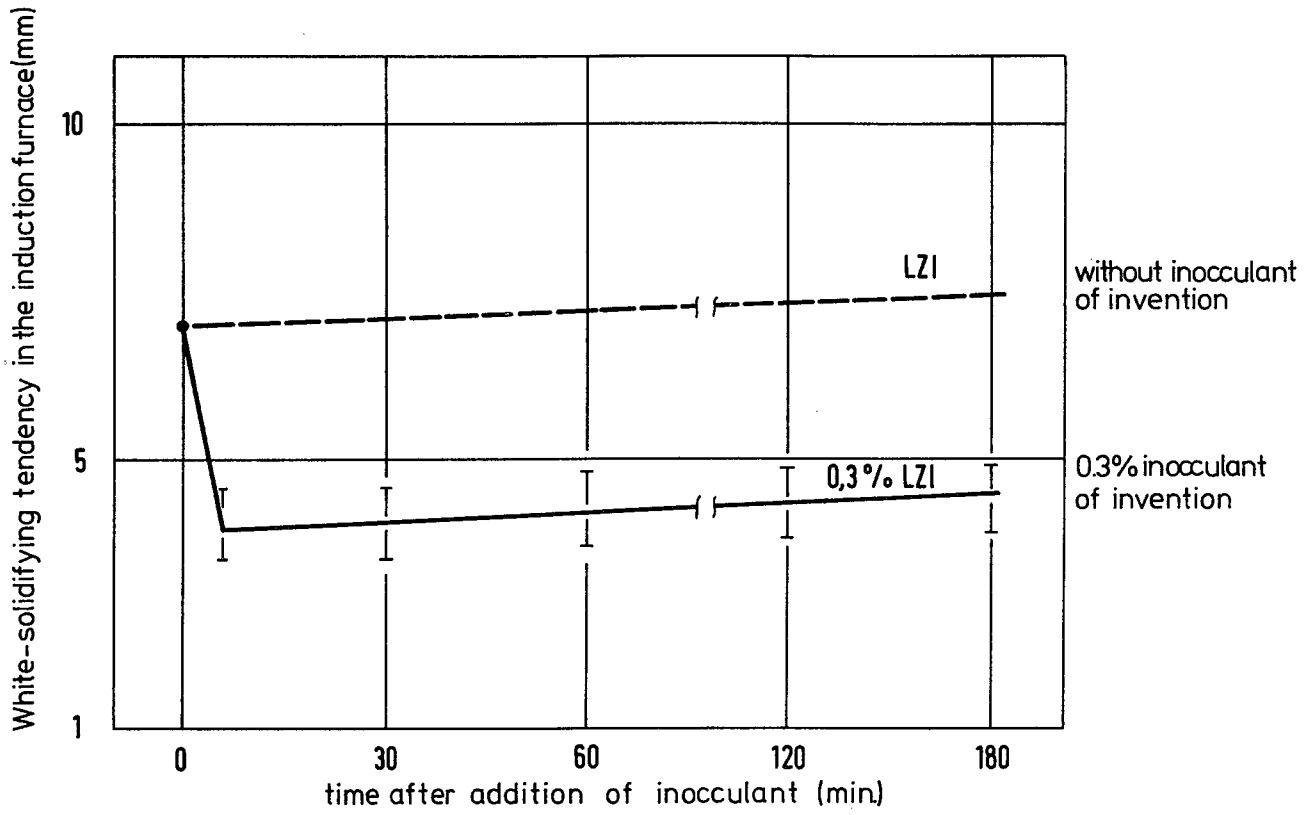
FIG. 2 is a graph of the white-solidifying tendency in an induction furnace against time, with and without the addition of the inocculant of the present invention.

By the addition of the slow fade inocculant of the present invention in an induction crucible furnace or apparatus for keeping the metal in a melted condition, an unchanging level of white-solidification was kept up for 3 hours and longer (FIG. 2).

In this respect, for evening out the solidification behavior, small, unchanging amounts of inocculant of about 0.1% on tapping were enough. The casting produced had:

a small number of eutectic cells,
fine A-graphite structures
a high enough strength,
a low number of blowholes,
a small amount of reaction products
(table 3).

EXAMPLE 4 (comparison example—nodular graphite cast iron)

Figure 3:
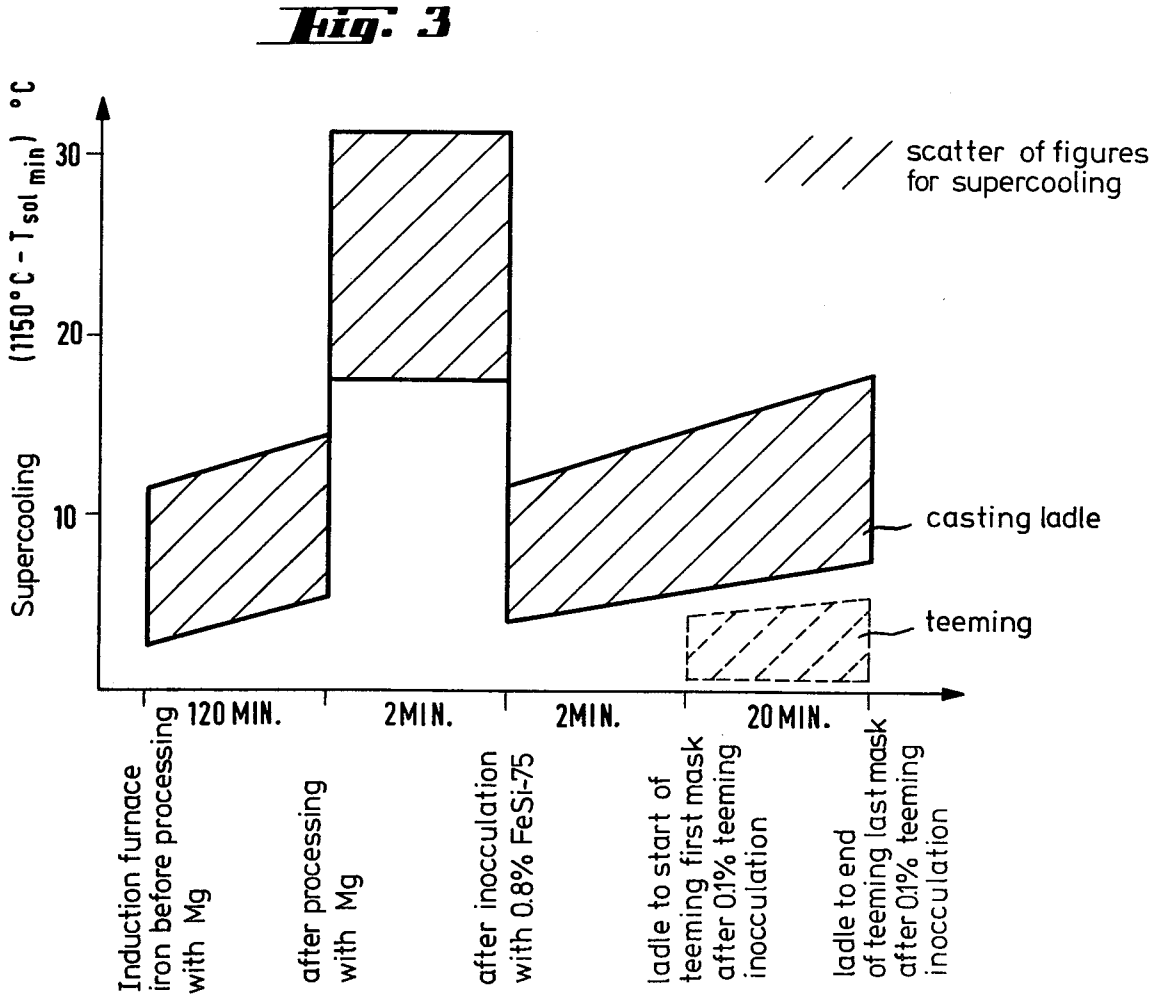
FIG. 3 is a graph with respect to scatter of supercooling figures in the case of normally conditioned cast iron.
Figure 5:
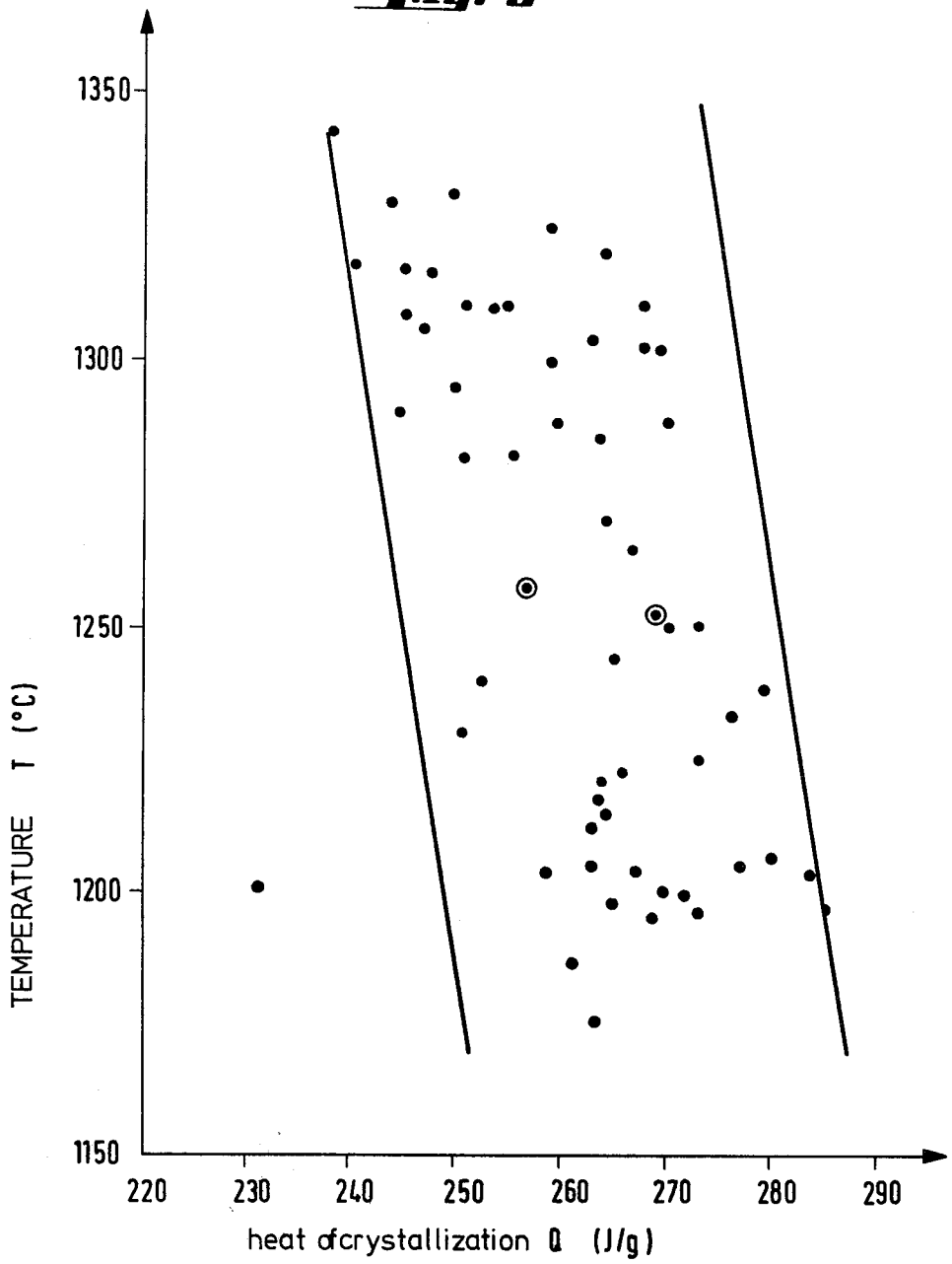
FIG. 5 is a graph of the scatter in the figures for heat of crystallization of the melt in the ladle in the case of normally processed cast iron.
Figure 6:
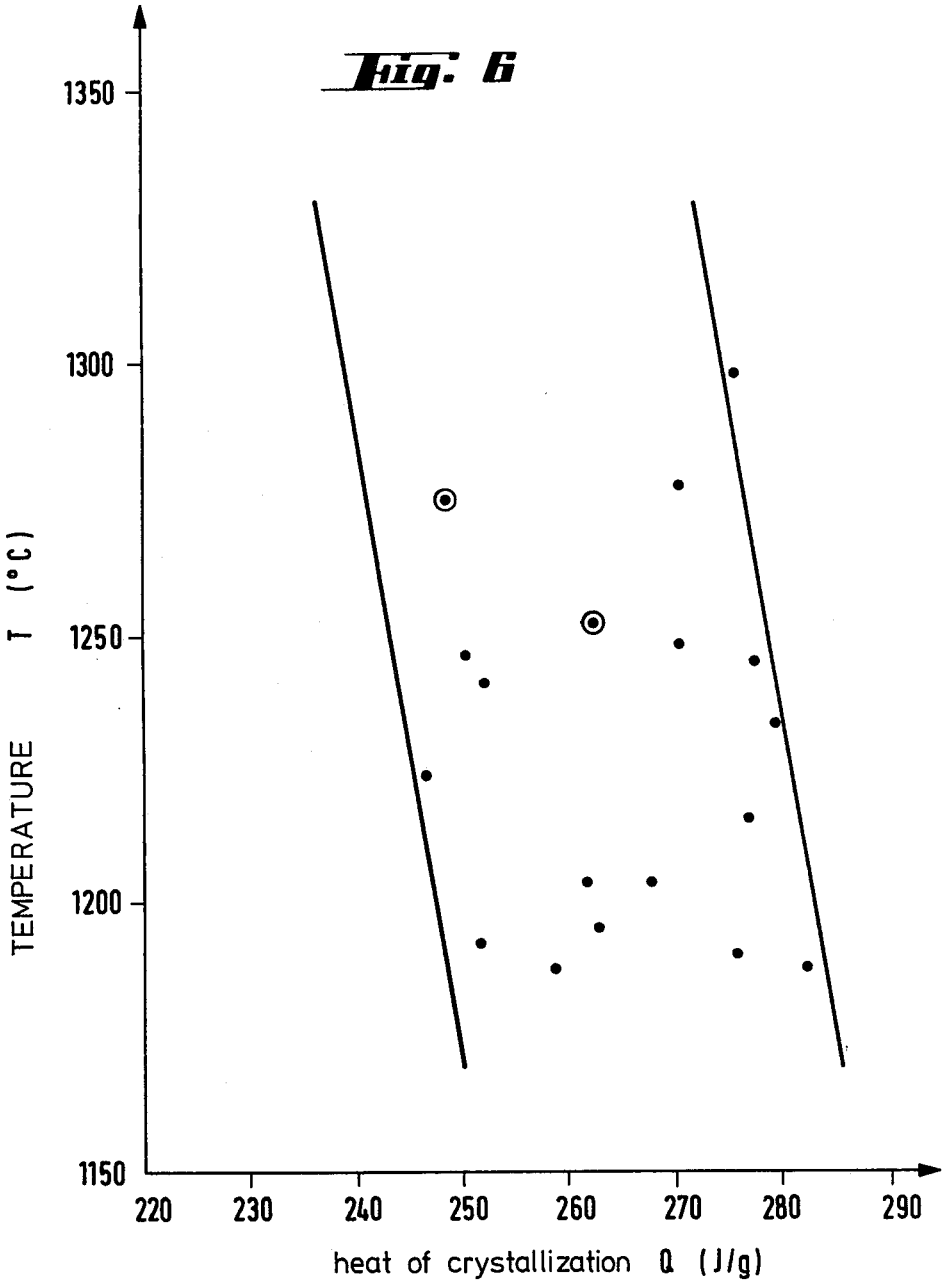
FIG. 6 is a graph on the same lines as figure with respect to teeming.
Figure 7:
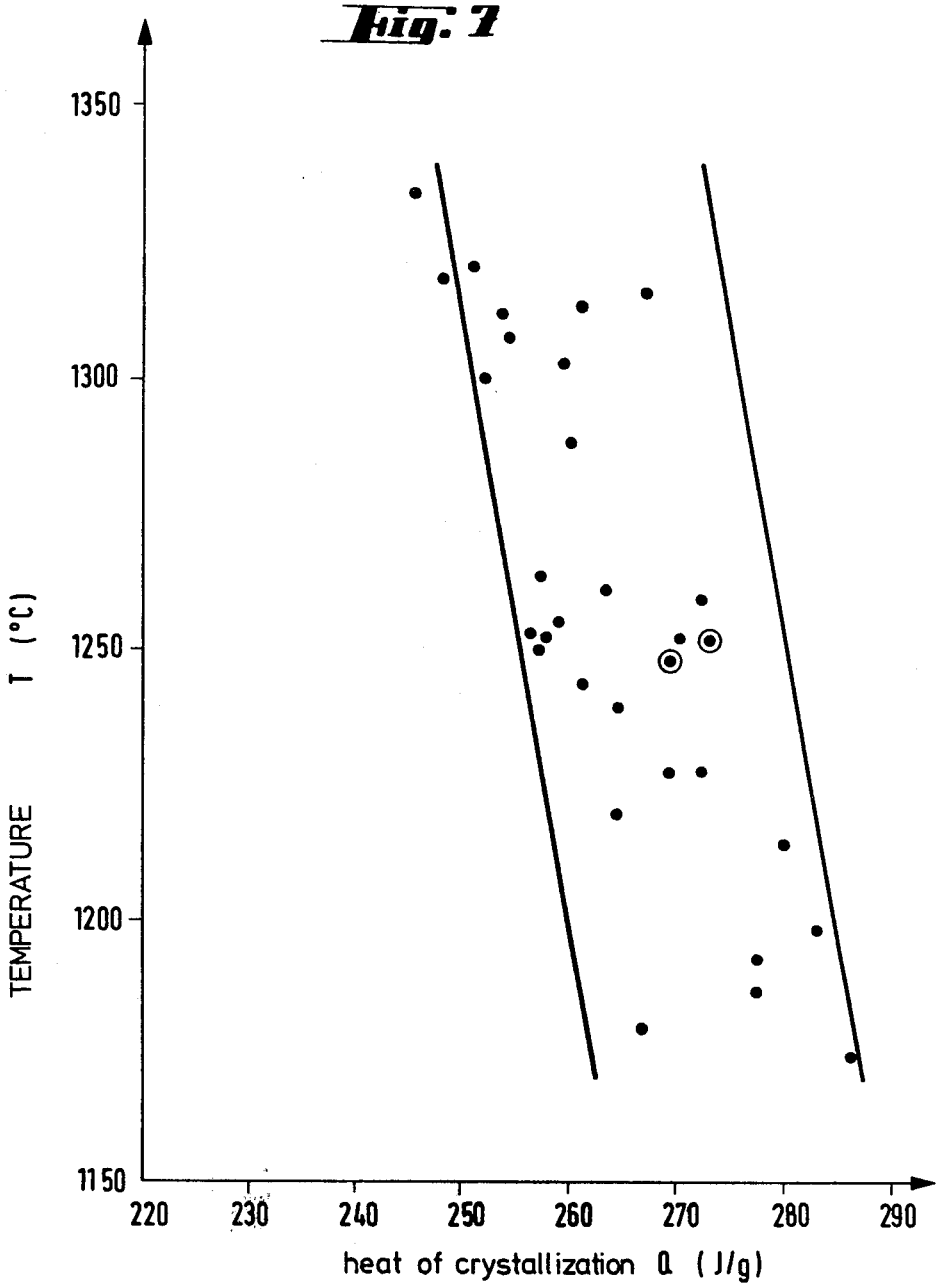
FIG. 7 is a graph of the scatter range of the heat of crystallization of the melt in the ladle in the case of cast iron conditioned with the present invention.
Figure 8:
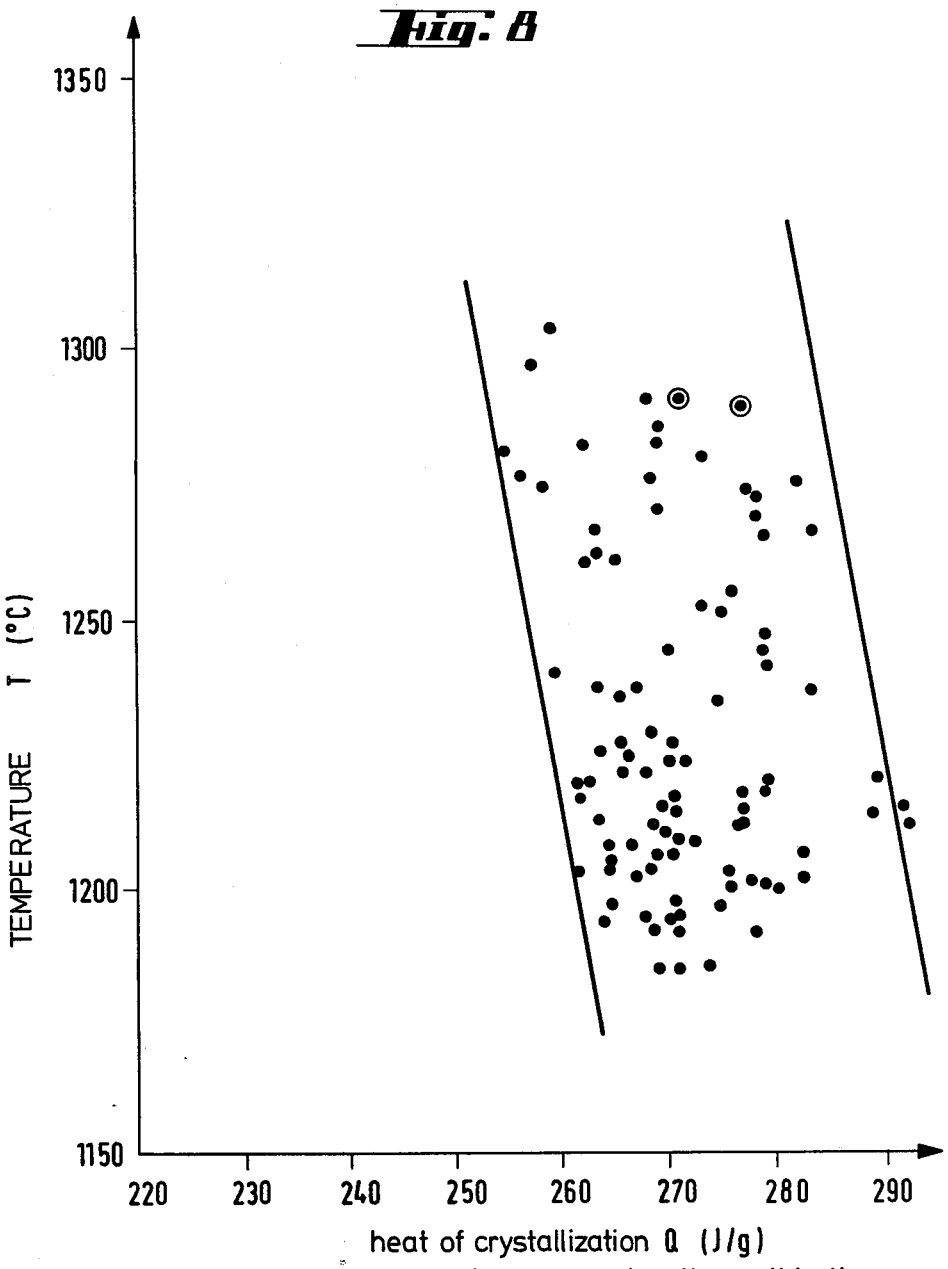
FIG. 8 is a graph on the same lines with respect to teeming.

Although having the same analysis and temperature, charges of melted cast iron were produced in a low frequency cricible furnace at different levels of the tendency to white-solidification, this being measured in the form of supercooling or as the degree of white-solidification in cast wedges. The longer the time the material was kept melted, the greater the tendency to white-solidification (FIG. 3).

On keeping the metal for two hours in an induction furnace at 1550° C., there was an increase in white-solidification from 2.5 to 5 mm and in supercooling from 4 to 10.5° C. After conditioning with magnesium, the white-solidification tendency was 12 mm and supercooling 28° C. By an inocculation with 0.8% by weight of FeSi 75, the white-solidification tendency and supercooling went down to 3.5 mm and 6.5° C. in the ladle and went up till at the end of teeming after 20 minutes they had levels of 6 mm and 13° C. (table 4, FIG. 3).

The heat of crystallization was, at the start of teeming, 265 J/g and at the end of teeming 260 J/g, while the maxima of the second differential coefficient were 0.20 and, in the other case, 0.15° C./sec$^2$ (table 4; FIGS. 5, 6, 9 and 10).

In order to make possible teeming of cementite-free castings at the end of the teeming operation with a degree of supercooling of 13° C. and a white-solidification tendency of 6 mm, inocculation on teeming with 0.1% by weight of inocculant was necessary. Although, in this case, the white-solidification tendency of the melt went down to 2.5 mm at the start and 3.0 mm at the end and supercooling went down to 1.5° C. and 2.5° C., the heat of crystallization going up by 5 J/g to only 268 J/g at the start and 265 J/g at the end of the teeming time, the maxima of the second differential coefficient kept the same at 0.19° C./sec$^2$ (table 4).

Figure 9:
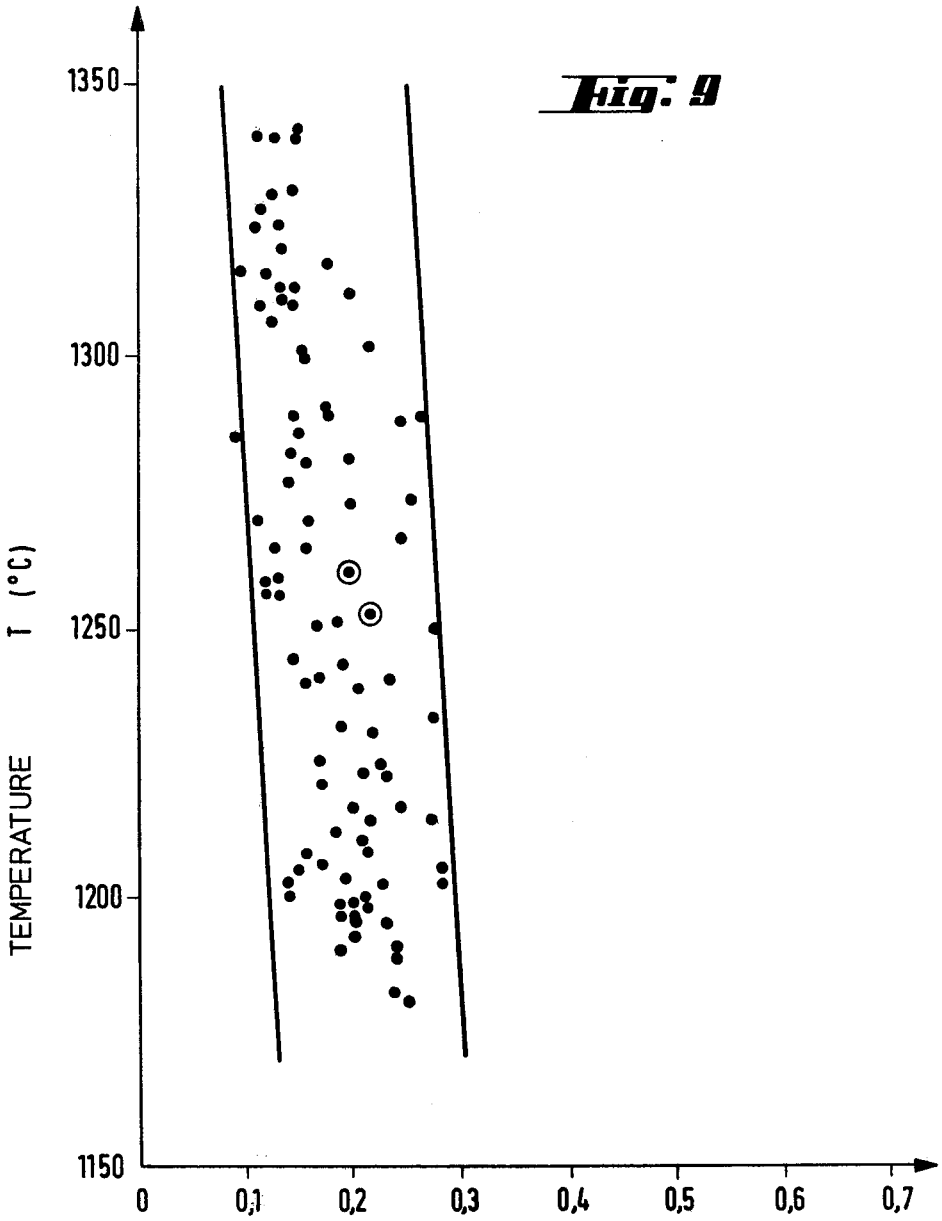
FIG. 9 is a graph of the scatter range of the maximums of the second differential coefficient of the temperature/time curve in the ladle in the case of cast iron processed normally.
Figure 10:
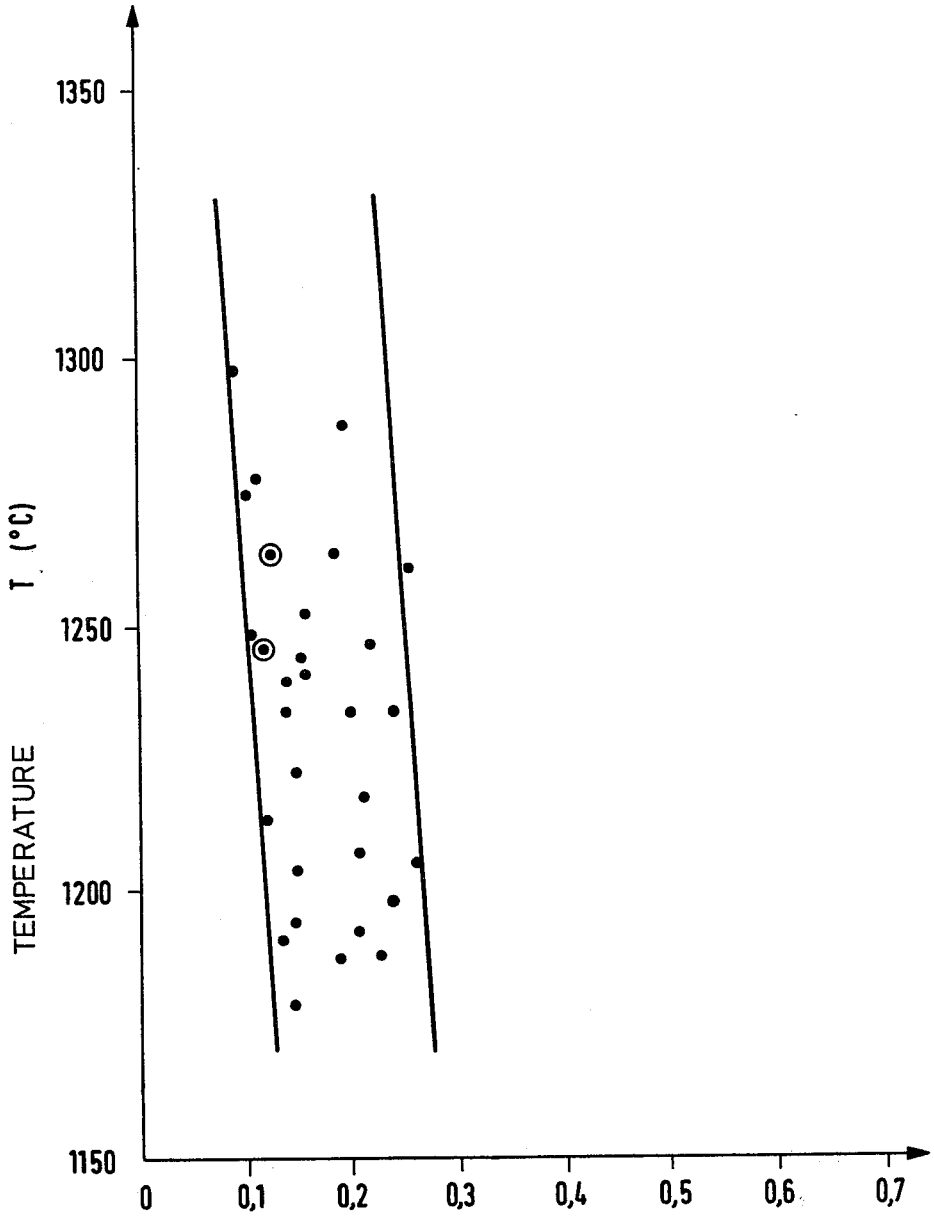
FIG. 10 is a graph on the same lines, but with respect to teeming.

Such melted cast iron has:

- a high value for the supercooling temperatures and a high white solidification tendency at the end of teeming before teeming inocculation
- lower heats of crystallization undergoing greater changes and a low self-feeding property (FIGS. 5 and 6)
- lower maxima of the second differential coefficient $d^2T/dt^2$ of the cooling curve against time and a worse feeding property (FIGS. 9 and 10).

EXAMPLE 5 (nodular graphite cast iron)

Melted cast iron, conditioned as in example 3, had, even after being kept for 2 hours and longer in a melted condition in an induction furnace, a white-solidification tendency of under 3 mm and supercooling values of under 5° C. (see FIG. 4 and table 5). White-solidification tendency and supercooling went up after magnesium conditioning have as well (9 mm, 21.5° C.). The melt was inocculated right after magnesium processing with 0.3% by weight of the inocculant given in example 3. Over the full time of 20 minutes, the values for the white-solidification tendency and supercooling kept generally unchanged at 4 mm and 8.0° C. In this respect the amounts of inocculant for teeming and in-mold inocculation were 0.03% by weight (for example in the form of FeSi) for stopping the coming into existence of primary cementite.

The conditioning of the melt, of which an account has been given, will make it clear that for the whole teeming time of the charge, the heats of crystallization were 10 J/g higher than in the comparison example 1; the maxima of the second differential coefficient kept unchanged at about 0.4° C./sec$^2$ and, for this reason, were twice as high as in the comparison example 1, that is to say near the transition to vermicular graphite (table 5, FIGS. 7, 8, 11 and 12).

The further teeming inocculation with 0.03% by weight of FeSi 75 put up the heats of crystallization once again by 5 J/g, while the maxima of the second differential coefficient were still 0.4° C./sec$^2$ (table 5, FIGS. 7, 8, 11, 12).

Figure 11:
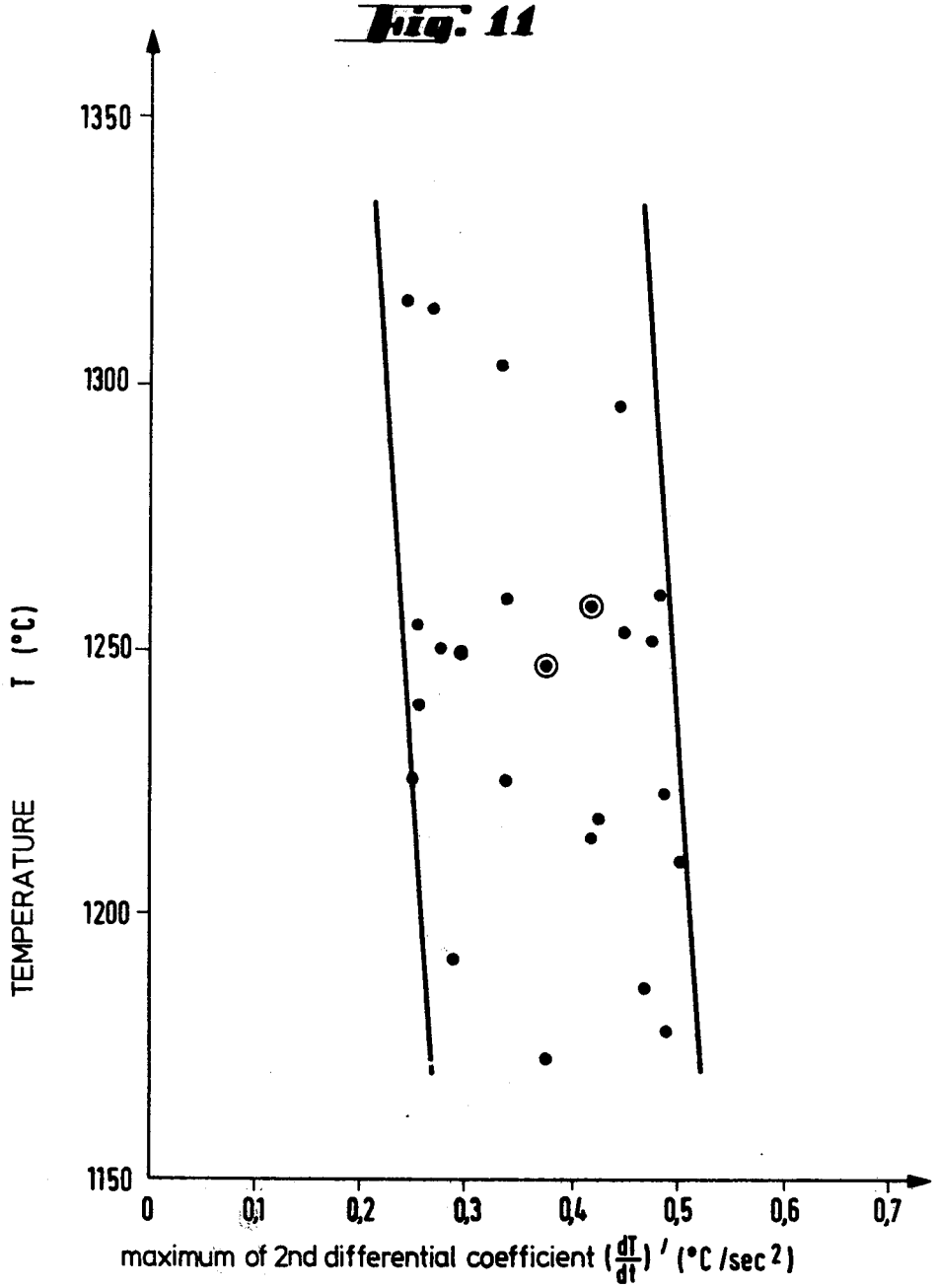
FIG. 11 is a graph of the scatter range of the maximums of the second differential coefficient of the temperature/time curve in the ladle in the case of cast iron processed in the present invention.
Figure 12:
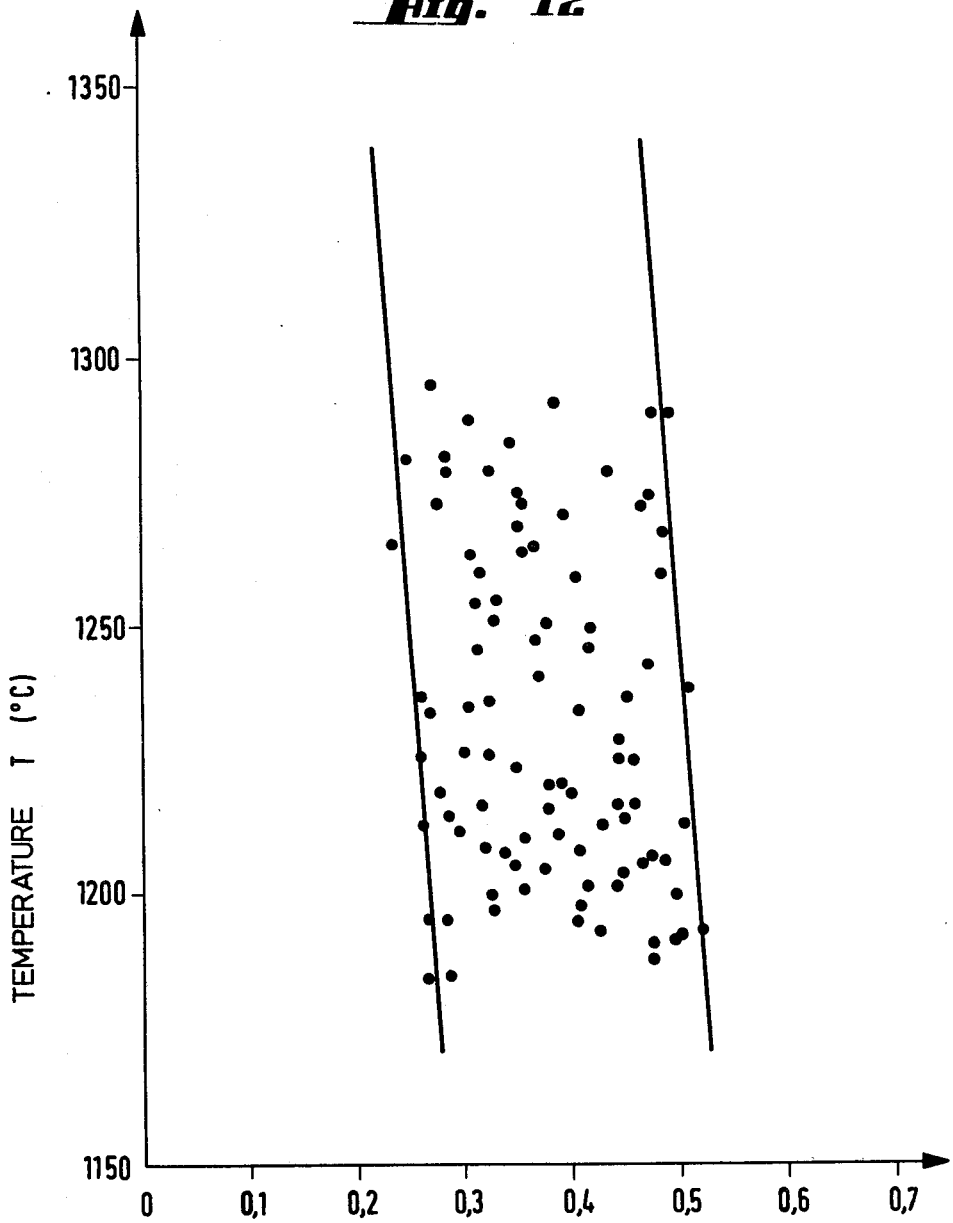
FIG. 12 is a graph on the same lines, but with respect to teeming.

So the effects produced are:

- a low and unchanging level of supercooling and the tendency to white solidification of the melt for the teeming time before teeming inocculation
- high heats of crystallization with a low scatter even before teeming inocculation, that is to say good self-feeding conditions (FIGS. 7 and 8)
- high, unchanging values for the maximum of the second differential coefficient of the cooling curve against time and better feeding properties (FIGS. 11 and 12).

The same effects may be produced on using the process of the invention for vermicular graphite cast iron.

We claim:

1. An inocullant for melted cast iron comprising:

(a) a silicon-containing matrix of iron-silicon alloys and having a crystal structure, (b) a high-melting point calcium aluminum silicate compound, present in the matrix crystal structure, and (c) a dicalcium aluminum silicate material with up to 20% by weight of silicon carbide and up to 10% by weight of calcium carbide, the weight ratio of the calcium-containing matrix with the high-melting point calcium aluminum silicate to the dicalcium silicate material being about 1:0.05 to about 1:0.2 and the amount of high-melting point calcium aluminum silicate in the silicon-containing matrix being 5 to 30% by weight.

2. The inocculant of claim 1, wherein said high-melting point calcium aluminum silicate is $CaO.Al_2O_3.2SiO_2+3Al_2O_3.2SiO_2$.

3. The inoccculant of claim 1, wherein the amount of high-melting point calcium aluminum silicate in the silicon-containing matrix is 8 to 15% by weight.

4. A process for the inocculation of melted cast iron, comprising adding an inocculant as claimed in claim 1 in an amount of 0.05 to 1% by weight to the melted cast iron.

5. A process as claimed in claim 4, comprising adding said inocculant in an amount of 0.1 to 0.5% by weight.

6. A process as claimed in claim 4 or claim 5, comprising adding said inocculant to the cast iron in an apparatus for keeping it in a melted condition, in and before the apparatus or to the melted cast iron in the forehearth.

7. A process as claimed in claim 4 or claim 5, comprising adding said inocculant to the burden or a material of the burden before melting, in an amount of 0.05 to 4% by weight.

8. A process as claimed in claim 4 or claim 5, said process producing nodular or vermicular graphite cast iron by conditioning melted cast iron with magnesium and/or rare earth elements and said process comprising, right after this conditioning step, further adding said inocculant in amount of 0.1 and 0.7% by weight.

9. A process as claimed in claim 6, said process producing nodular or vermicular graphite cast iron by conditioning melted cast iron with magnesium and/or rare earth elements and said process comprising, right after this conditioning step, further adding said inocculant in amount of 0.1 and 0.7% by weight.

10. A process as claimed in claim 7, said process producing nodular or vermicular graphite cast iron by conditioning melted cast iron with magnesium and/or rare earth elements and said process comprising, right after this conditioning step, further adding said inocculant in amount of 0.1 and 0.7% by weight.

11. A process as claimed in claim 8, wherein the amount of the inocculant is 0.2 to 0.4% by weight.

12. A process as claimed in claim 9, wherein the amount of the inocculant is 0.2 to 0.4% by weight.

13. A process as claimed in claim 10, wherein the amount of the inocculant is 0.2 to 0.4% by weight.

14. A process as claimed in claim 11, wherein the amount of the inocculant is 0.2 to 0.4% by weight.

* * * * *

UNITED STATES PATENT AND TRADEMARK OFFICE
CERTIFICATE OF CORRECTION

PATENT NO. : 4,292,075
DATED : September 29, 1981
INVENTOR(S) : Friedrich Wolfsgruber et al It is certified that error appears in the above—identified patent and that said Letters Patent is hereby corrected as shown below:

Column 1, line 13, delete the first occurrence of "cast" and substitute therefor --case--.

Column 3, lines 37-38, delete the sentence fragment "The level of the calcium aluminum silicate together.".

Column 5, between lines 46 and 47, insert the following:

TABLE 1: normal processing

| Tendency to white-solidification in the induction furnace | Addition of inoculant in induction furnace | Tendency to white-solidification in the induction furnace | Addition of inoculant outside furnace | white-solidification tendency on tapping | material properties | | | | | | | | analysis | | | | | |
|---|---|---|---|---|---|---|---|---|---|---|---|---|---|---|---|---|---|---|
| | | | | | HB | $\sigma_B$ | graphite | | | graphite size | base structure | eut. cells per cm² | C | Si furnace | Si chunk | Mn | S | Cr |
| | | | | | | | A | B | D | | | | | | | | | |
| mm | % | mm | % | mm | N/mm² | N/mm² | % | % | % | | % | | % | % | % | % | % | % |
| 5,0 | | 5,0 | 0,5 | 2,0 | 207 | 297 | 100 | - | - | 4-6 | 100% Perlit | 700 | 3,35 | 1,60 | 1,90-2,20 | 0,80 | 0,08 | 0,2 |

UNITED STATES PATENT AND TRADEMARK OFFICE
CERTIFICATE OF CORRECTION

PATENT NO. : 4,292,075
DATED : September 29, 1981
INVENTOR(S) : Friedrich Wolfsgruber et al It is certified that error appears in the above—identified patent and that said Letters Patent is hereby corrected as shown below:

Column 5, after line 68, insert the following:

TABLE 2: Use of normal inocculants in induction furnace

| Tendency to white-solidification in the induction furnace | Addition of inoccu-lant in induction furnace | Tendency to white-solidification in the induction furnace | Addition of inoccu-lant out-side furnace | white solidifi-cation tendency on tapping | material properties | | | | | | | | analysis | | | | | |
|---|---|---|---|---|---|---|---|---|---|---|---|---|---|---|---|---|---|---|
| | | | | | HB | $\sigma_B$ | graphite | | | base-structure | eut. cells per cm² | | C | Si fur-nace | Si chunk | Mn | S | Cr |
| | | | | | | | A | B | D | | | | | | | | | |
| mm | % | mm | % | mm | $\frac{N}{mm^2}$ | $\frac{N}{mm^2}$ | % | % | % | | % | | % | % | % | % | % | % |
| 6,0 | 0,3 | 5,5 | 0,5 | 3,0 | 191 | 279 | 100 | - | - | 4-6 | 100 % Perlit | 600 | 3,35 | 1,40 | 1,00-2,20 | 0,80 | 0,08 | 0,2 |

Column 6, between lines 19 and 20, insert the following:

UNITED STATES PATENT AND TRADEMARK OFFICE

CERTIFICATE OF CORRECTION

PATENT NO. : 4,292,075

DATED : September 29, 1981

INVENTOR(S) : Friedrich Wolfsgruber et al

It is certified that error appears in the above—identified patent and that said Letters Patent is hereby corrected as shown below:

TABLE 3: Use of inocculant of the present invention in induction furnace

| Tendency to white-solidification in the induction furnace | Addition of inoculant in induction furnace | Tendency to white-solidification in the induction furnace | Addition of inoculant outside furnace | white solidification tendency on tapping | material properties | | | | | | | | analysis | | | | | |
|---|---|---|---|---|---|---|---|---|---|---|---|---|---|---|---|---|---|---|
| | | | | | HB | $\sigma_B$ | graphite | | | base-structure | eut. cells per cm² | | C | Si furnace | Si chunk | Mn | S | Cr |
| | | | | | | | A | B | D | | | | | | | | | |
| mm | % | mm | % | mm | N/mm² | N/mm² | % | % | % | | % | | % | % | % | % | % | % |
| 5,5 | 0,3 LZI | 3,5 | 0,1 | 2,5 | 201 | 262 | 100 | - | vz | 4-6 | 100 % PERLIT | 450 | 3,35 | 1,70 | 1,90 | 0,80 | 0,08 | 0,2 |

Column 6, line 24, delete "cricible" and insert therefor --crucible--.

Column 6, between lines 45 and 46, insert the following:

UNITED STATES PATENT AND TRADEMARK OFFICE
CERTIFICATE OF CORRECTION

PATENT NO. : 4,292,075
DATED : September 29, 1981
INVENTOR(S) : Friedrich Wolfsgruber et al It is certified that error appears in the above—identified patent and that said Letters Patent is herebv corrected as shown below:

Table 4

| Last charge of a furnace | Induction furnace | after magnesium processing | ladle start of charge | ladle end of charge | teeming start of charge | teeming end of charge |
|---|---|---|---|---|---|---|
| White silidification (mm) | 5,0 | 12,0 | 3,5 | 6,0 | 2,5 | 3,0 |
| Supercooling (°C) | 10,5 | 28,0 | 6,5 | 13,0 | 1,5 | 2,5 |
| heat of crystallisation (J/g) (1250°C) | – | – | 265 | 260 | 268 | 265 |
| Maximum of second differential coefficient (°C/sec²) $(\frac{dT}{dt})'$ (1250°C) | – | – | 0,20 | 0,15 | 0,19 | 0,19 |
| Temperature (°C) | 1550 | 1450 | 1410 | 1360 | – | – |
| Carbon (%) | 3,78 | 3,78 | 3,78 | 3,78 | 3,78 | 3,78 |
| Magnesium (%) | – | 0,045 | 0,042 | 0,040 | 0,040 | 0,039 |
| Silicon (%) | 1,90 | 1,90 | 2,45 | 2,45 | 2,45 | 2,45 |
| Phosphorus (%) | 0,056 | 0,055 | 0,056 | 0,056 | 0,056 | 0,055 |
| Sulfur (%) | 0,010 | 0,009 | 0,009 | 0,009 | 0,009 | 0,009 |
| Manganese (%) | 0,30 | 0,30 | 0,30 | 0,30 | 0,30 | 0,30 |
| Chromium (%) | 0,02 | 0,02 | 0,02 | 0,02 | 0,02 | 0,02 |

UNITED STATES PATENT AND TRADEMARK OFFICE
CERTIFICATE OF CORRECTION

PATENT NO. : 4,292,075

DATED : September 29, 1981

INVENTOR(S) : Friedrich Wolfsgruber et al

It is certified that error appears in the above—identified patent and that said Letters Patent is hereby corrected as shown below:

Column 7, line 7, after the period and before "White-solidifica-", insert the following:

Table 5

| Last charge of a furnace | | Induction furnace | after magnesium processing | ladle start of charge | ladle end of charge | teeming start of charge | teeming end of charge |
|---|---|---|---|---|---|---|---|
| White solidification | (mm) | 3,0 | 9,0 | 3,5 | 4,0 | 2,0 | 2,5 |
| Supercooling | (°C) | 4,5 | 21,5 | 5,7 | 8,0 | 0,7 | 1,3 |
| heat of crystallization (1250°C) | (J/g) | - | - | 275 | 270 | 280 | 274 |
| maximum of second differential coefficient $(\frac{dT}{dt})'$ (1250°C) | (°C/sec²) | - | - | 0,42 | 0,38 | 0,43 | 0,40 |
| Temperature | (°C) | 1550 | 1440 | 1405 | 1350 | - | - |
| Carbon | (%) | 3,78 | 3,78 | 3,78 | 3,78 | 3,78 | 3,78 |
| Magnesium | (%) | - | 0,042 | 0,040 | 0,038 | 0,038 | 0,037 |
| Silicon | (%) | 2,05 | 2,05 | 2,21 | 2,21 | 2,23 | 2,23 |
| Phosphorus | (%) | 0,055 | 0,055 | 0,056 | 0,055 | 0,056 | 0,056 |
| Sulfur | (%) | 0,008 | 0,008 | 0,007 | 0,008 | 0,007 | 0,007 |
| Manganese | (%) | 0,30 | 0,30 | 0,30 | 0,30 | 0,30 | 0,30 |
| Chromium | (%) | 0,03 | 0,03 | 0,03 | 0,03 | 0,03 | 0,03 |

UNITED STATES PATENT AND TRADEMARK OFFICE

CERTIFICATE OF CORRECTION

PATENT NO. : 4,292,075

DATED : September 29, 1981

INVENTOR(S) : Friedrich Wolfsgruber et al

It is certified that error appears in the above—identified patent and that said Letters Patent is hereby corrected as shown below:

Column 7, line 51 (line 1 of Claim 1), delete "inocullant" and substitute therefor --inocculant--.

Signed and Sealed this

*Fifth* Day of *April 1983*

[SEAL]

*Attest:*

GERALD J. MOSSINGHOFF

*Attesting Officer*

*Commissioner of Patents and Trademarks*